US006424810B1

(12) United States Patent
Chappell

(10) Patent No.: US 6,424,810 B1
(45) Date of Patent: Jul. 23, 2002

(54) SYSTEM FOR REDUCTION OF CONTAMINANT COLLECTION SYSTEM AIRFLOW REQUIREMENTS

(75) Inventor: James M. Chappell, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/728,228

(22) Filed: Nov. 30, 2000

(51) Int. Cl.[7] ..... G03G 21/00; G03G 21/20
(52) U.S. Cl. ..... 399/92
(58) Field of Search ..... 399/92, 93, 98–101

(56) References Cited

U.S. PATENT DOCUMENTS 5,146,279 A 9/1992 Seyfried
5,689,766 A * 11/1997 Hollar et al. ..... 399/92
5,862,439 A 1/1999 Pozzanghera ..... 399/98
6,067,428 A 5/2000 Zirilli et al. ..... 399/92

* cited by examiner

*Primary Examiner*—William J. Royer
(74) *Attorney, Agent, or Firm*—Oliff & Berridge, PLC; Eugene Palazzo

(57) ABSTRACT

A method and apparatus for cleaning a ductwork network system is disclosed. An image forming system is provided having a ductwork network cleaning system for passing a fluid and particulate matter therethrough. There is included at least one fluid regulating element, which is coupled to the ductwork network and to a subsystem of the image forming system. The fluid regulating element regulates fluid flow through the ductwork network. Also provided is a fluid displacement device, which is in fluid communication with the ductwork network. The fluid displacement device displaces fluid within the ductwork network. Most commonly, the fluid contained within the image forming system is air.

18 Claims, 6 Drawing Sheets

SYSTEM FOR REDUCTION OF CONTAMINANT COLLECTION SYSTEM AIRFLOW REQUIREMENTS

FIELD OF THE INVENTION

The present invention relates to an electrostatographic printing machine, and relates more particularly to an active airflow system therein for containing, transporting, and purging particulate contaminants therefrom.

BACKGROUND OF THE INVENTION

In an electrostatographic imaging device, the following general process is implemented. A photoconductive member is first charged to a substantially uniform potential. The charge carrying surface of the photoconductive member is then exposed to a light image of a document. The charge on selective areas of the photoconductive member is dissipated by the light image. This results in an electrostatic image being recorded on the photoconductive member, which corresponds to the document being reproduced. The electrostatic image is subsequently developed into a visible image by depositing a charged developing material onto the photoconductive member. The developing materials, e.g., toner particles, are attracted to the charged image areas on the photoconductive member. This attraction creates a toner image on the photoconductive member, which is then permanently affixed to a copy sheet.

When multicolor electrostatographic printing is desired, a similar process is executed. In black and white printing, a single image is formed on the photoconductive member in order to reproduce a document. In multicolor electrostatographic printing, multiple images corresponding to different colors are individually recorded on the photoconductive member. Then each electrostatographic image is developed with toner of a single complementary color, and the process is repeated for different colored images and respective different colored toner. Subsequently, each single color toner image is transferred to the copy sheet in superimposed registration with the prior toner image. This creates a multilayered toner image on the copy sheet. The multilayered toner image is permanently affixed to the copy sheet.

In electrostatographic printing, some development systems utilize two component developer mixes or single component developer materials as well as powder or liquid developer materials. In the two component developer mix, the dyed or colored thermoplastic powder is combined with coarser ferromagnetic granules. The thermoplastic powder, otherwise known as toner particles, and the ferromagnetic granules, otherwise known as carrier beads, are selected to ensure that the toner particles acquire a desired electrostatic charge relative to the electrostatic image recorded on the photoconductive member. As the developer mix is brought into contact with the charged photoconductive member, the larger attractive force of the electrostatic image recorded on the photoconductive member causes the toner particles to transfer from the carrier beads to the electrostatic image.

In order to control toner deposition, known development systems utilize rotary impellers, fur brushes, bucket conveyors and magnetic brush systems. Of these systems, the magnetic brush system has proven more effective. Such a system includes a developer roll with a directional magnetic flux field, which promotes contact between the developer mix and the photoconductive member.

One issue associated with the aforementioned developing process is the unintentional or inadvertent escape of developing material, specifically liquid or dry toner particles, from the developer housing. Toner particles that carry an electrostatic charge are readily attracted to various surfaces within the electrostatographic printing machine. This attraction can result in the contamination of various machine components. Further, because of the charge on the toner particles, escaping toner particles can be developed on the photoreceptor, which produces a background image on the reproduction of the document. Such contamination caused by floating toner particles adversely affects the performance and reliability of the electrostatographic printing machine. As a further example, developing material such as toner particles can collect on, e.g., a lamp, a mirror, a lens, etc. Such occurrences generate unacceptable copy quality as well as unscheduled and more frequent maintenance and repair visits by service technicians.

In multi-color electrostatographic printing machines, the escape of toner particles can cause intermingling of different color toner particles, which in turn causes contamination of the development system. It is therefore desirable to prevent the escape of toner particles and other particulate matter from each developer housing to prevent the contamination of the development system.

To address the issue of toner particle escape, one of ordinary skill in the art can appreciate that a developer housing can include a seal or other physical barrier to prevent the escape or migration of the toner particles outside of the developer housing. In addition, one can appreciate that a developer housing can be maintained at a negative pressure relative to the ambient environment of the electrostatographic printing machine. This generates an inner flow through a duct system, which transports toner particles and other particulate matter out of the developer housing. Typically, the duct systems or ductwork networks include ducts, which direct the airflow into a filter or other depository area.

One issue associated with the negative pressure ductwork network solution is that typically such systems require a significant bulk airflow. The majority of the airflow is required to maintain adequate particulate matter transport velocities to minimize contaminant deposition throughout the ductwork network. In a four housing full color system, the total bulk flow requirement for the development subsystem becomes 60 $ft^3$/min. When combined with the bulk airflow requirements of other subsystems, such as the cleaner (50 $ft^3$/min) and hybrid air knife (25 $ft^3$/min) subsystems, the blower system requirements can exceed 135 $ft^3$/min, which exceeds desired product performance levels for cost, power, and noise.

SUMMARY OF THE INVENTION

For the foregoing reasons, there exists in the art a need for an image forming system, such as an electrostatographic printing system, having a ductwork network cleaning system that adequately transports toner particles and particulate matter through the ductwork network as desired without exceeding product performance levels for cost, power, and noise. The present invention is directed toward further solutions in this art.

In accordance with one aspect of the present invention, an image forming system is provided having a ductwork network for passing, or transporting, a fluid and particulate matter therethrough. The system also includes at least one fluid regulating element coupled to the ductwork network and to one or more subsystems of the image forming system. The fluid regulating element regulates fluid flow through the ductwork network. Also provided is a fluid displacement device, in fluid communication with the ductwork network for displacing fluid within the ductwork network. Most commonly, the fluid contained within the image forming system is air.

According to one aspect of the present invention, the fluid regulating element comprises a shutoff valve.

According to another aspect of the present invention, the fluid displacement device comprises a blower. The blower creates a pressure (negative or positive) within the ductwork network to displace the fluid, e.g., air, within the ductwork network and to transport the particulate matter through the system.

According to still another aspect of the present invention, a method is provided for cleaning the ductwork network in the image forming system. The method includes activating the fluid displacement device to establish a selected fluid pressure and create a fluid flow within at least a portion of the ductwork network. Such fluid pressure transports particulate matter through the ductwork network. The method further includes purging sections of the ductwork network by activating at least one fluid regulating element within the ductwork network. Such purging diverts fluid flow and generates an increased fluid flow level through sections of the ductwork network being purged, which transports an additional amount of particulate matter through the ductwork network. According to still neither aspect of the present invention, the purging step includes purging the ductwork network during one of a cycle-up, cycle-down, or dead cycle system state.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

Figure 1:
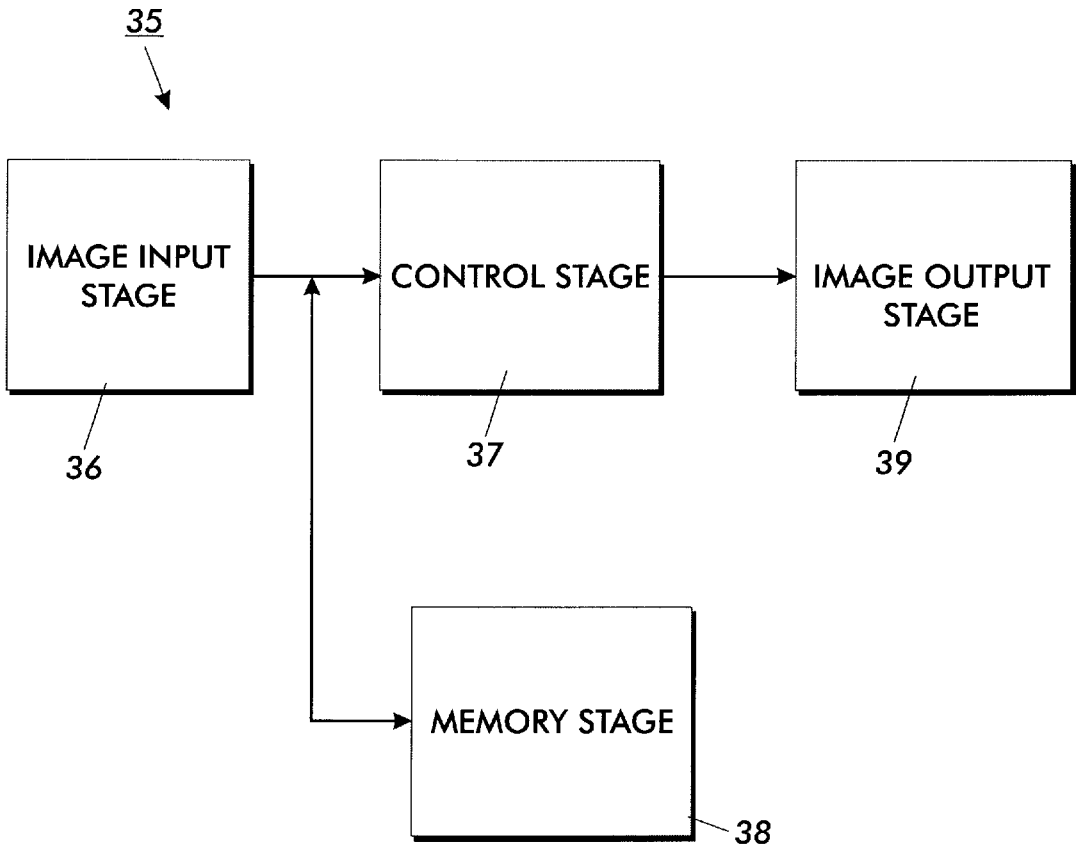
FIG. 1 is a schematic block diagram of a general image forming system suitable for use with the teaching of the present invention.

The present invention generally relates to image forming systems, such as electrostatographic image printing systems. Within such a system, a ductwork network connects one or more developer subsystems in addition to other subsystems, such as a cleaner subsystem, a hybrid air knife subsystem, and other known and conventional subsystems. The present invention provides for coupling a fluid regulating element to the ductwork network for regulating the pressure therein to transport toner particles and particulate matter there through.

Referring now in detail to the drawings wherein like parts are designated by like reference numerals throughout, FIGS. 1 through 6 illustrate example embodiments of image forming systems according different aspects of the present invention. Although the present invention will be described with reference to the example embodiments illustrated in the figures, it should be understood that the present invention can be embodied in many alternative forms. In addition, any suitable size, shape, or type of elements or materials can be utilized.

One broad example of a general image forming or reproducing system employing a ductwork network 142 is illustrated in FIG. 1. The illustrated image reproducing system 35 includes an image input stage 36 that is adapted to acquire or receive image data, such as an image of a document. The image data is then transferred to either or both a control stage 37 and a memory stage 38. The memory stage 38 can include any suitable storage or memory module adapted for storing the image data, examples of which include RAM, ROM, floppy disks, hard drives, and the like. The control stage 37 includes an arrangement for controlling the retrieval from, or transfer to, image data in the memory stage 38, as well as controlling the transfer of image data to an image output stage 39. The illustrated image output stage 39 can include any suitable apparatus for reproducing the image on a substrate, such as a conventional printer or copier.

Figure 2:
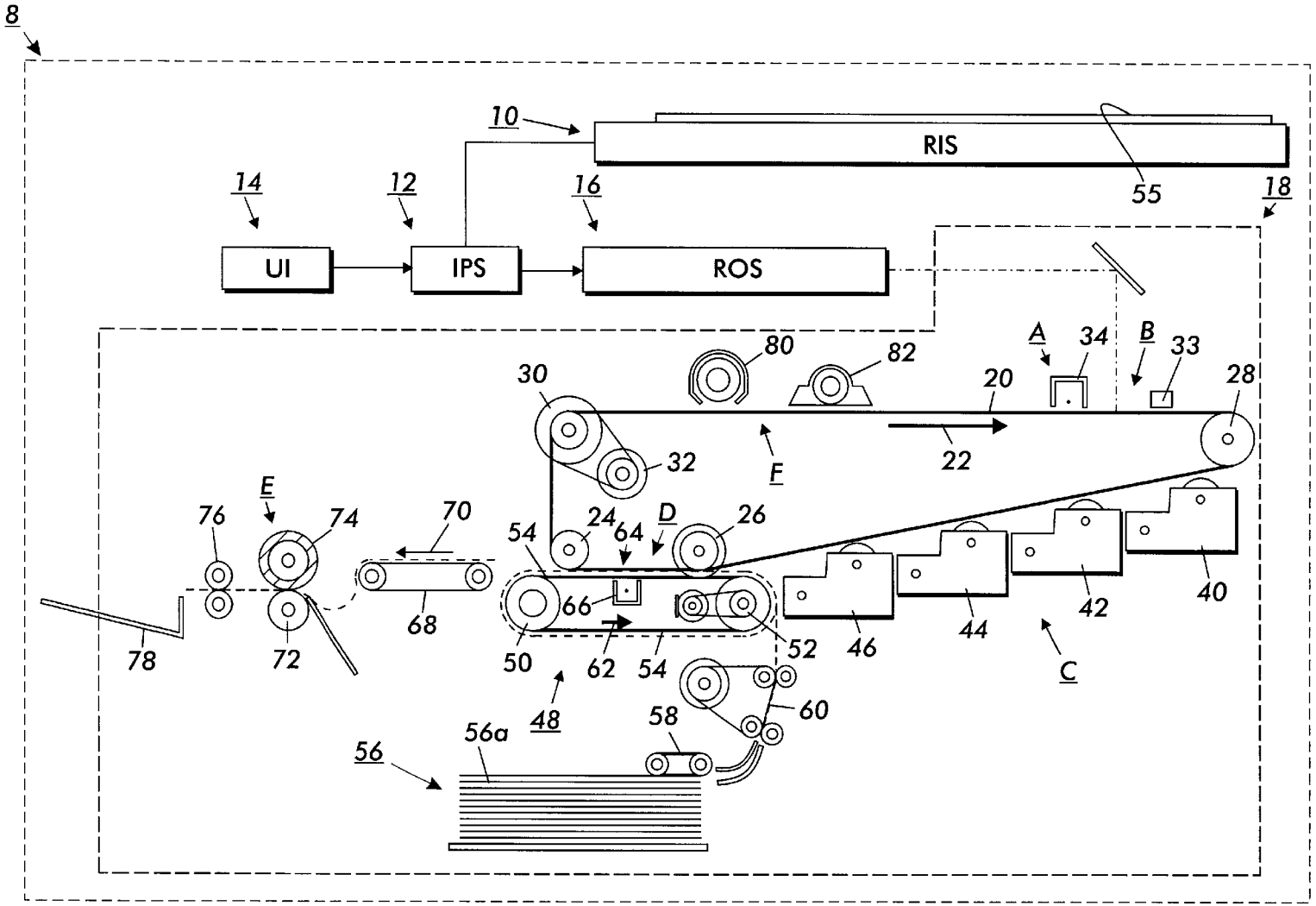
FIG. 2 is a diagrammatic illustration of an electrostatographic printing device according to one embodiment of the present invention.

In an effort to provide a base structure for understanding the features and advantages of the present invention, FIG. 2 illustrates an electrostatographic image forming device 8. The electrostatographic image forming device 8 can be, for example, a multi-color digital copier. To reproduce an original document 55, the multi-color document is placed on a raster input scanner 10. The raster input scanner 10 captures an entire image from the original document 55, and converts the image to a series of raster scan lines. A set of primary color densities, e.g., red, green, and blue, are measured at each point of the original document 55. The measurements are then transmitted to an image processing system 12, which translates the set of red, green, and blue density signals to a set of calorimetric coordinate signals. The image data flow is managed and sent to a raster output scanner 16.

A user interface 14 communicates with the image processing system 12. The user interface 14 allows an operator to control various operator adjustable functions within the electrostatographic image forming device 8. The user interface 14 can comprise, e.g., a keyboard, a mouse, a track ball, a touch pad, or a touch screen. Any input provided to the user interface 14 is subsequently transmitted to the image processing system 12, as well as the raster output scanner 16.

The raster output scanner 16 can include a laser with rotating polygon mirror locks. Through use of a mirror, the raster output scanner 16 illuminates a charged portion of a photoreceptor belt 20 within a printer or marking engine 18. A typical rate of illumination is approximately 400 pixels per inch. The raster output scanner exposes the photoreceptor belt 20 and records a set of images thereon corresponding to the signals transmitted from the image processing system 12. Each image within the set is developed with a different colored developer material. The developed images are then transferred to a copy sheet to form a multi-color image which is then fused to form a color copy.

The photoreceptor 20, according to one embodiment, is fabricated from a photoconductive material coated on a grounding layer, which is then coated on an anticurl backing layer. The photoconductive materials are made from a transport layer coated on a generator layer. The transport layer transports positive charges from the generator layer, which allows light to pass therethrough. It will be appreciated by one of ordinary skill in the art that various suitable photoconductive materials, grounding layers, and anti-curl backing layers may be employed.

According to one example embodiment of the present invention an electrostatographic image forming device 8 is provided. In the printer or marking engine 18, a photoconductive belt moves in the direction of arrow 22 to advance the photoconductive surface through several processing stations along the path of movement. The photoreceptor belt 20 winds through rotatably mounted transfer rollers 24 and 26, tension roller 28, and drive roller 30. The drive roller 30 is powered by a belt drive 32.

As a first step in the process, a portion of the photoreceptor belt 20 passes through a charging station A. At charging station A, a corona generating device 34 charges the photoreceptor belt 20 to a relatively high, substantially uniform, potential.

Next in the process, the charged photoconductive surface is rotated to an exposure station B. The exposure station B receives a modulated light beam which corresponds to information derived by the raster input scanner 10. The modulated light beam selectively eliminates the charge surface of the photoreceptor belt 20 to form an electrostatic image on the photoreceptor belt 20. In a multi-color image derived from a multi-color document, the photoreceptor belt is exposed three times to record three separate images, one for each color.

Next in the process, the photoreceptor belt 20 advances towards a toner development station C. Prior to reaching the toner development station C, the photoreceptor belt passes an electrostatic voltmeter 33. The electrostatic voltmeter 33 measures the voltage potential at the surface of the photoreceptor belt 20.

According to an aspect of the present invention, the toner development station C includes four separate developer subsystems 40, 42, 44, and 46. The developer subsystems 40, 42, 44 and 46 can be magnetic brush development units having a magnetizable developer material. The magnetizable developer material typically includes magnetic carrier granules triboelectrically adhered to toner particles. The developer material continuously moves through a directional flux field, forming a brush of developer material. Development is executed by bringing the brush of development material into contact with the photoconductive surface.

The separate color of the toner particles in each developer subsystem 40, 42, 44, and 46, absorbs light within a predetermined spectral region of the electromagnetic we spectrum. For example, an electrostatic image formed by discharging the portions of charge on the photoreceptor belt 20 corresponding to the green region of the document will record the red and blue portions of areas of relatively high charged density on the photoreceptor belt 20. The green areas will be reduced to a voltage level in effect for development. The charged areas are then made visible by having the developer subsystem 40 apply green absorbing toner particles (magenta) until the electrostatic image recorded on the photoreceptor belt 20. A similar process is followed for each of the other developer subsystems 42, 44, and 46.

Next in the image reproduction process, the toner image is moved to electrostatic transfer station D. The electrostatic transfer station D includes a transfer zone 64. The transfer zone 64 defines the position at which the toner image is transferred to a copy sheet 56*a*, which may be a sheet of plain paper. Sheet transport apparatus 48 moves the copy sheet 56*a* into contact with the photoreceptor belt 20. The sheet transport apparatus 48 includes a belt 54 which holds through a pair of substantially cylindrical rollers 50, 52. A friction retard feeder 58 advances the top most sheet from the stack 56 of copy sheets 56*a* onto a pre-transfer transport 60 for advancing the copy sheet 56*a* to the sheet transport apparatus 48, such that a leading edge of the copy sheet 56*a* arrives at a predetermined position, such as a loading zone. As belt 54 of the sheet transport apparatus 48 moves in the direction of arrow 62, the copy sheet 56*a* is moved into contact with the photoreceptor belt 20 substantially simultaneous with the toner image developed thereon.

In the transfer zone 64, a corona generating device 66 sprays ions onto a backside of the copy sheet 56*a* to charge the copy sheet 56*a* to the proper magnitude and polarity for attracting the toner image from the photoreceptor belt 20. Accordingly, three different color toner images are transferred to the copy sheet 56*a*, one on top of the other.

Upon completion of the last transfer operation, the sheet transport apparatus 48 directs the copy sheet 56*a* to a vacuum conveyor 68. The vacuum conveyor 68 transports the copy sheet 56*a* in the direction of arrow 70 to a fusing station E where the transferred toner image is permanently fused to the copy sheet 56*a*. The fusing station E includes a pressure roller 72 and a fuser roller 74. The copy sheet 56*a* passes through the pressure roller 72 and fuser roller 74, as the toner image contacts the fuser roller 74 to be affixed to the copy sheet 56*a*. The copy sheet 56*a* is then advanced by a pair of rolls 76 to a catch tray 78 for subsequent removal by the machine operator. A final step in the process occurs at cleaning station F. A lamp 80 illuminates the surface of the photoreceptor belt 20 to remove any residual charge. Then, a rotatably mounted fibrous brush 82 maintains contact with the photoreceptor belt 20, removing any residual toner particles remaining from the transfer operation.

As described, an electrostatographic image reproduction apparatus may take the form of any of several well known devices or systems. Variations of specific electrostatographic processing subsystems or processes are to be expected without affecting the operation of the present invention.

Figure 3:
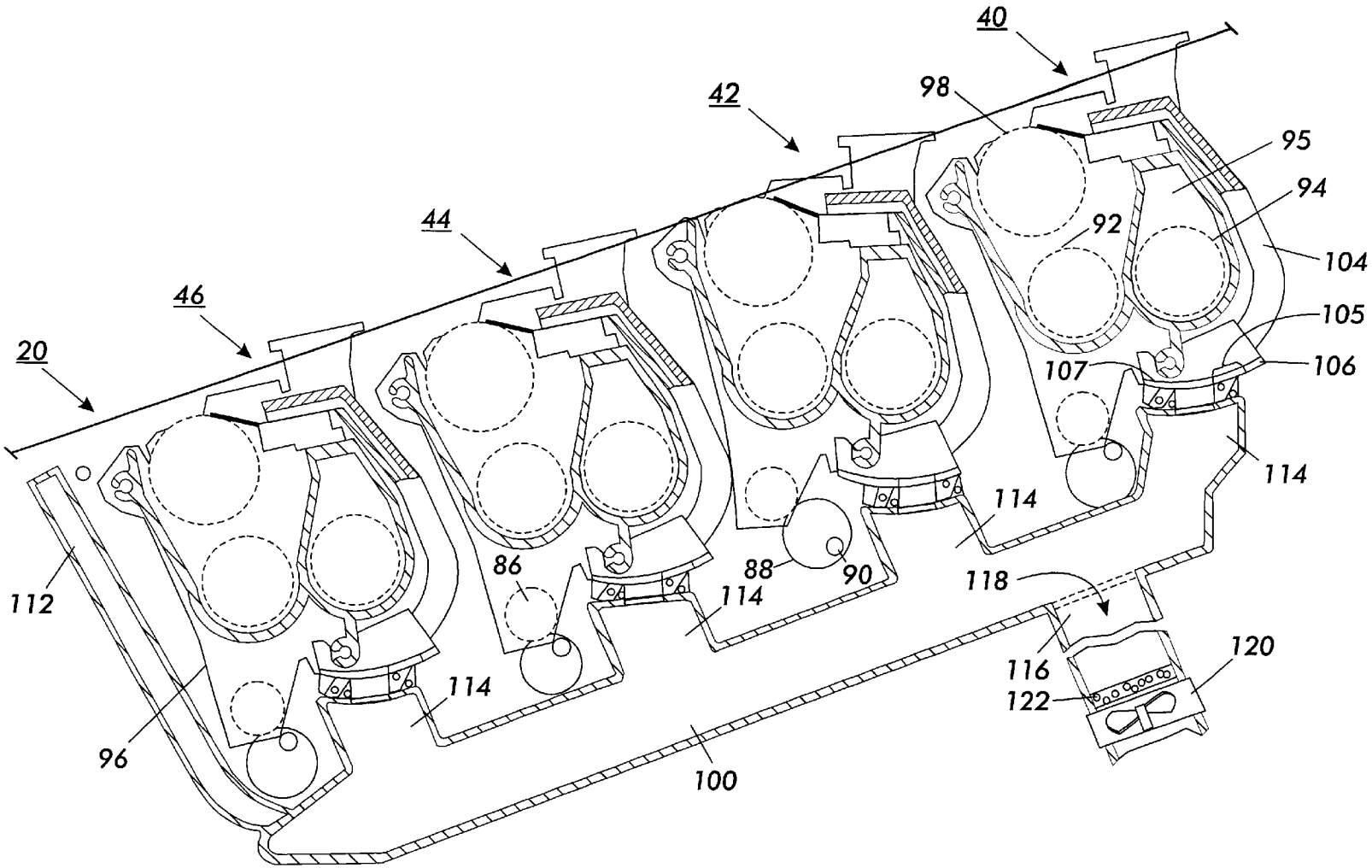
FIG. 3 is a schematic illustration of a collection of developer devices within the electrostatic printing device of FIG. 2 according to the teaching of the present invention.

In further detail, a collection of example developer subsystems is illustrated in FIG. 3. The primary distinction between each of the developer subsystems 40, 42, 44, and 46, is the color of the toner particles contained within. Because each of the developer subsystems 40, 42, 44, and 46 is substantially structurally identical, the features and components of a single developer subsystem will be described in detail.

A developer subsystem 40 includes a housing 96, which defines a chamber having a developer roll 98 rotatably mounted therein. Also mounted within housing 96 are mixing augers 92 and 94. The mixing augers 92 and 94 rotate in opposite directions to mix the toner particles and carrier beads of the developing material stored within the chamber of housing 96. The mixing function creates opposite charges on the toner particles and carrier beads, causing them to be attracted to one another through triboelectrification.

The developer roll 98, according to one example embodiment, includes a stationary cylindrical magnet disposed within the rotating sleeve having an irregular exterior surface. The magnet field produced by the fixed magnetic core of the developer roll 98 attracts the developer material from the mixing augers 92 and 94 to the rotating sleeve of the developer roll 98. The developing material is then transported to make contact with the electrostatic image recorded on the photoreceptor belt 20.

Each developer housing 96 mounts to a support frame via a pivot pin 95. The developer housing 96 is supported on a cam 88 via a pinion wheel 86 mounted on the housing 96 and exterior to the chamber defined by the housing 96. A shaft 90 is coupled to a motor (not shown) for rotating the cam 88. The motor rotates the cam 88, which exerts a force against the pinion wheel 86 to raise or lower the developer subsystem, as desired, in and out of an operative position adjacent the photoreceptor belt 20.

During the image reproduction process, the cam 88 is rotated by the motor coupled to the shaft 90, and the developer housing 96 rotates about the pivot pin 95 into an operative position. As cam 88 is further rotated, the developer housing 96 is rotated about the pivot pin 95 into a non-operative position. Utilizing this process, the developer material of developer subsystem 40 is spaced from the photoreceptor belt 20 prior to the next developer subsystem 42, for example, being positioned in an operative position for further development of an image. This hinders intermingling of the different toner color particles.

According to another aspect of the present invention, the developer subsystem includes an active system for generating negative air pressure to create airflow through the airflow system. The active airflow system comprises the ductwork network 142 including an air plenum 100 and individual air ducts 104 associated with each developer subsystem 40, 42, 44, and 46. There is provided a stationary air inlet port 112 in air plenum 100, a plurality of air channels 114, and at least one exhaust port 116. Air inlet port 112 provides a constant supply of air into the air plenum 100. Exhaust port 116 couples the air plenum 100 to an exhaust fan 120 driven by a motor (not shown) to generate the negative air pressure within the airflow system, generally in the direction of arrow 118.

According to another aspect of the present invention, the exhaust port 116 can be coupled to a detachable filter element 122 for separating and capturing airborne contaminants for particulate matter including toner particles, from the airflow therethrough. In one embodiment, the filter element 122 is an electrostatic filter layer comprising laminated layers of thin fibers such as polyvinyl chloride, polyester, polyacrylonitrite, polyethylene, polypropylene or the like. According to another aspect of the present invention, a cyclone separator (not shown) can be utilized prior-to filtering the airflow.

Depending upon the characteristics of the developer roller 98 and the type of toner utilized, sufficient airflow may be generated to cause the flow of particulate matter through the ductwork network 142 of the airflow system without the use of an exhaust fan 120, since negative pressure can be generated within the development system through alternative means. For example, airflow is generated by the movement of the photoreceptor belt 20 in the direction of arrow 22, which creates a flow of air into each developer housing chamber, which causes air to flow through each air duct 104 to the air plenum 100. An additional element that induces airflow is the rotation of the developer roll 98. The combined airflow causes particulate matter to flow through the aperture at the interface between the air duct 104 and the air plenum 100, removing contaminants from the developing region. Toner particle accumulation and other particulate matter accumulation is thereby hindered by this inherent airflow. However, this method of relying on inherent airflow to transport particulate matter has proven not to be sufficient in higher speed applications absent an additional vacuum source, such as a blower. The present invention further ensures that toner particles and other particulate matter will not escape from a developer housing 96 to intermingle with toner particles from other developer housings, or further contaminate the image reproduction process.

In operation, the developer roll 98 is positioned adjacent to the photoreceptor belt 20 to transport the developer material to the photoreceptor belt 20, which develops the electrostatic image. While in the operative position, a valve member 106 is rotated such that an aperture 105 aligns with the aperture of the air channel 114, which creates an interface between the air duct 104 and the air plenum 100. While in a non-operative position, the housing 96 is moved, which aligns a seal member 107 with the aperture of the air channel 114, closing the interface between the air duct 104 and the air plenum 100 to prevent airflow therethrough. This process can if desired, shut off air ducts when they are not in use, thereby reducing overall airflow requirements in the active airflow system.

During a development process, the air plenum 100 directs a negative air pressure airflow through each developer housing 96 through the air duct 104. The negative pressure has the effect of drawing airborne toner particles and other particulate matter away from the photoreceptor belt 20 and toward the air plenum 100. Subsequently the particles can exit the system through exhaust port 116. The magnitude of the negative air pressure is selected such that the airflow does not disturb the carrier granules on the developer roll 98, while still providing sufficient airflow to draw airborne toner particles away from the photoreceptor belt 20.

Aspects of the present invention are applicable to a number of different image forming systems. As a second, alternative structure, applicant hereby incorporates by reference U.S. Pat. No. 6,067,428 in its entirety as another example of an electrophotographic printing system, which can likewise support an implementation of the present invention. The developer subsystem from U.S. Pat. No. 6,067,428 has been recreated as FIG. 4 herein, and reference numbers reassigned for purposes of a more detailed description of an implementation of the present invention in conjunction with the developer subsystem.

Figure 4:
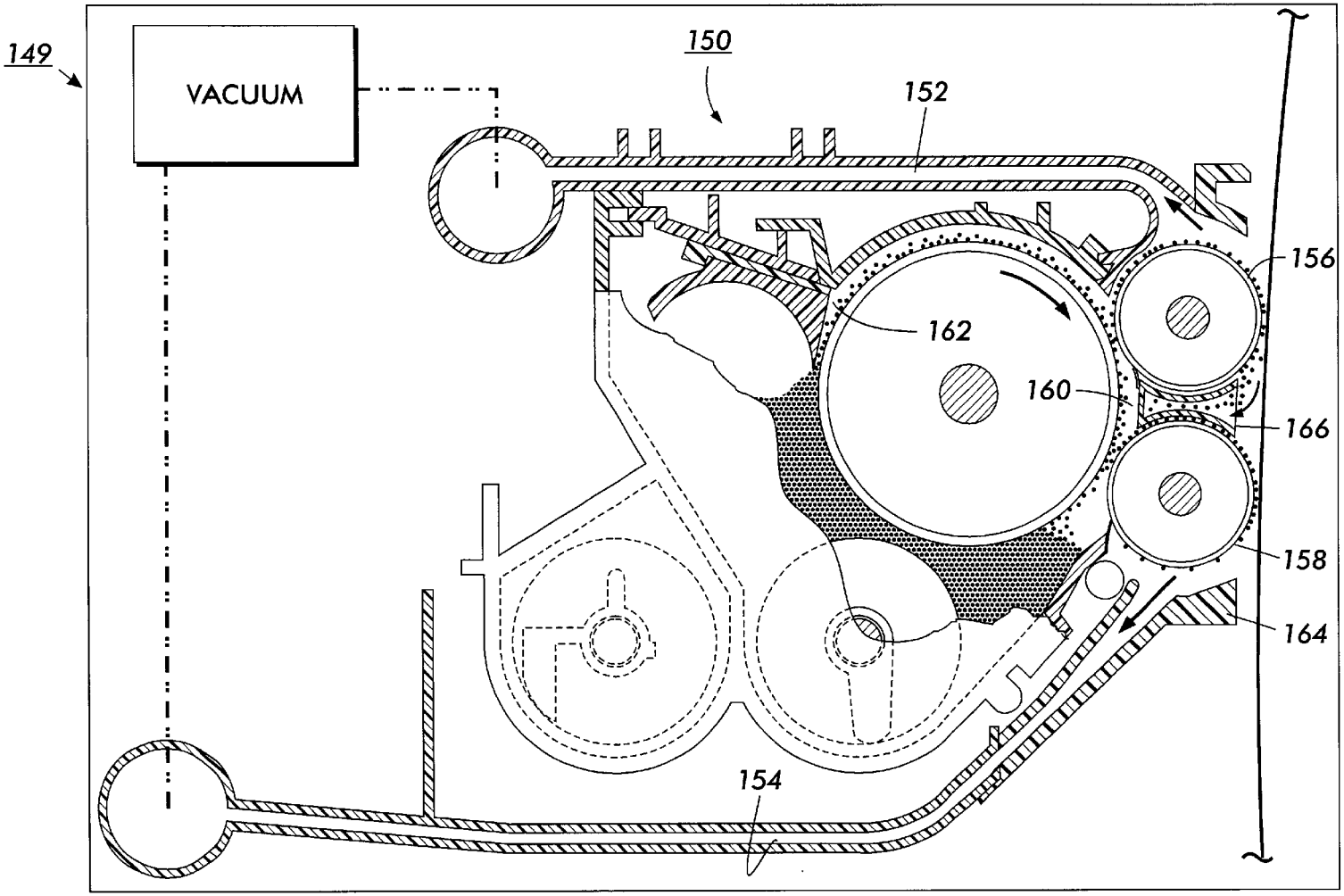
FIG. 4 is a diagrammatic illustration of an alternative developer device within an alternative printing device according to the teaching of the present invention.

Referring to FIG. 4, a developer system 150 of a type employed in an electrophotographic printing system 149 includes two air ducts 152 and 154. Each duct has a constant negative airflow leading from the donor roll areas 156 and 158. The bulk of the particulate matter typically escapes through region 160. An additional location is region 162, where particulate matter escapes. Extensive research has shown that the surfaces of wire module support frames 164 and 166, which form the wall of the air ducts within the developer system 150 around the donor rolls 156 and 158, and photoreceptor belt 20.

The upper and lower air ducts 152 and 154 (also called manifolds) are positioned with vacuum inlet plenum centerlines facing the donor rolls 156 and 158 at approximately 11 o'clock and 7 o'clock respectively. The specific positioning results in significant reduction of particulate matter deposition under constant airflow conditions. Additional ductwork modifications as described in the '428 have lead to further reductions of particulate matter deposition throughout the various branches of ductwork. However, the image forming system of the '428, like the previously described electrostatographic image forming device 8, requires a constant airflow rate throughout the ductwork to carry unwanted toner particles and particulate matter away from sensitive areas and components within the image forming system.

Figure 5:
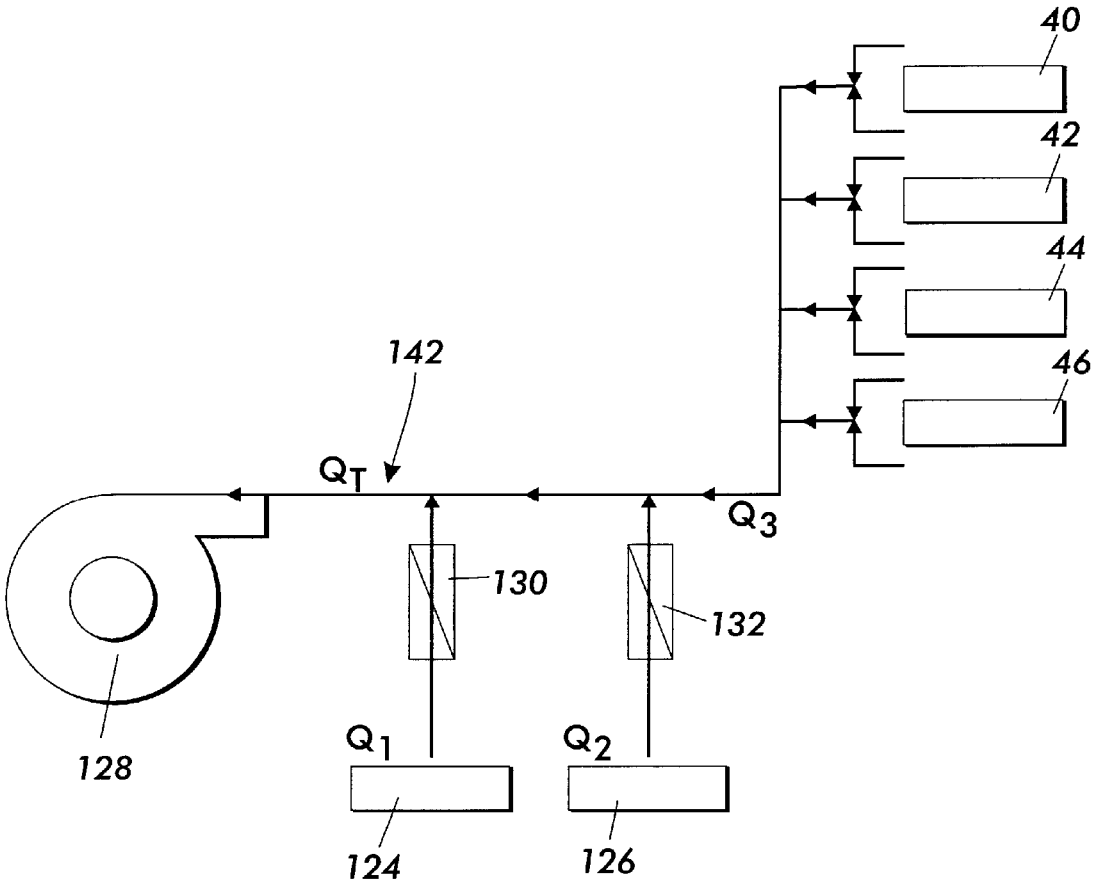
FIG. 5 is a schematic illustration of the ductwork network according to the teaching of the present invention.

FIG. 5 is a schematic illustration of the ductwork network 142 which is typically housed within the image forming device 8, or alternatively can be housed in the electrophotographic printing system 149. In all instances, the ductwork network 142 illustrated is in accordance with the teachings of the present invention. Those of ordinary skill in the art will readily recognize that the ductwork network 142 can include any selected number and arrangement of communicating fluid passages that are designed to transport a fluid, and if desired, toner particles and particulate matter, therethrough. The ductwork network 142 can be mounted or disposed within the electrostatographic image forming device 8, or the electrophotographic printing system 149, and can also be configured to communicate with the external environment through any appropriate fluid connector formed in the housing of the device.

For purposes of simplicity, the developer subsystems, 40, 42, 44, and 46 are illustrated and further discussed in conjunction with aspects of the present invention. However, applicant by no means intends to limit application of the present invention only to the image forming device 8, the electrophotographic printing system 149, or other image forming systems not described or specifically incorporated herein. Rather, applicant intends that the teachings of the present invention are applicable to numerous image forming systems having differing variations of airflow ductwork networks within to transport remaining toner particles and other unwanted particulate matter away from areas and components that would otherwise affect image quality or system performance if contaminated with such particles.

Each of the illustrated developer subsystems 40, 42, 44, and 46, coupled to the network are depicted symbolically. The ductwork network 142 can also include any number of fluid regulating elements 130 and 132 to control the airflow to the exemplary device subsystems, such as the illustrated cleaner subsystem 124 and the hybrid air knife subsystem 126. Those of ordinary skill in the art will readily recognize that the fluid regulating elements can be disposed at many different locations, and can communicate with any selected subsystem. In previous image forming systems, the fluid regulating elements 130 and 132 were not employed. In such systems, the airflow required at Q3 (total developer subsystem airflow) to effectively remove the particulate matter and toner particles from the developer subsystems 40, 42, 44, 46, was in the order of 60 $ft^3$/min. This requirement, plus other subsystem requirements, such as, e.g., 25 $ft^3$/min at Q2 (airflow from the second subsystem) and 50 $ft^3$/min at Q1 (airflow from the first subsystem), resulted in a total system airflow requirement of 135 $ft^3$/min at $Q_T$ (system airflow) in order to properly displace air therethrough with the illustrated fluid displacement device 128.

As utilized herein, the term "fluid regulating element"is intended to include any suitable type of element for regulating, controlling, or adjusting the fluid flow through one or more portions of the ductwork network 142 and/or device subsystems. Examples of suitable types of fluid regulating elements include valves, such as shut-off valves, bellows, seals, and the like. Further, as utilized herein, the term "fluid displacement device"is intended to include any suitable device capable of displacing fluid within the ductwork network 142 and/or device subsystems by creating a pressure differential therein, including positive or negative pressures. Examples of suitable types of devices include blowers, pumps, and the like.

According to one embodiment of the present invention, during normal run cycles of the electrostatographic image forming system 8, the overall device airflow is significantly reduced such that $Q_T$ is about 87 $ft^3$/min. This allows Q1 at the cleaner subsystem 124 to be maintained at its specified level of about 50 $ft^3$/min, and allows Q2 at the hybrid air knife subsystem 126 to be maintained at its specified level of 25 $ft^3$/min, while providing 12 $ft^3$/min to the developer subsystems 40, 42, 44, and 46 at Q3 during normal operation. The lower airflow requirements are made possible by the fact that by incorporating a purge mode (described in further detail hereafter), the need to constantly maintain the transport velocity at higher levels to avoid major deposition in the ductwork network 142 is eliminated. With the purge mode, the required airflow is based on the capture velocity required to capture airborne particulate matter at duct entrances, which also is sufficient for transporting the particulate matter with moderate deposition in the ductwork network 142. The purge mode then cleans out the moderate depositions.

To clean the ductwork network 142 of particulate matter and toner particles, the system periodically enters a purge mode. In such a mode, one or more of the fluid regulating elements 130 and 132 is activated to selectively reduce or restrict airflow to predetermined subsystems, e.g., the cleaner subsystem 124 or the hybrid air knife subsystem 126, at predetermined times within the image forming process. The cleaner subsystem 124 electrostatically cleans residual toner that was not transferred to the copy sheet 56*a* from the photoreceptor belt 20 and directs it to a waste sump (not shown) using air flow. The hybrid air knife subsystem 126 cleans other debris and particulate matter that cannot be cleaned electrostatically from the photoreceptor belt 20 prior to transferring additional toner for a subsequent image. Thus, these particular subsystems not in use at all times, and therefore provide for opportunities to reduce or restrict airflow to the subsystems, redirecting the airflow as described herein.

In general, the ductwork network 142 typically supports an airflow through the various passages. The airflow is generated by the fluid displacement device or blower 128 as previously described. The present invention provides for the periodic activation of certain fluid regulating elements 130 and 132 to restrict the airflow to certain portions of the ductwork network 142, thereby creating an increased airflow in the remaining portions. The purge mode occurs during certain selected time intervals, such as cycle-up, cycle-down, and dead-cycle time system states, during which the fluid regulating elements 130 and 132 restrict the airflow to the cleaner subsystem 124 and the hybrid air knife subsystem 126. These are instances when the cleaner subsystem 124 and the hybrid air knife subsystem 126 are not in use. It should be noted that the cleaner subsystem 124 and the hybrid air knife subsystem 126 have been chosen in this example embodiment due to their airflow characteristics as described, however, the invention is not limited to restricting flow to only these two subsystems. Any subsystem or other component or element that forms a portion of the ductwork network 142 and partakes of the airflow therethrough can be identified as a potential subsystem or component to reduce or restrict airflow in exchange for increased airflow in other portions of the ductwork network 142. All that is required is that the particular subsystem or component comprise at least periods of time during which airflow is not required, such that it may be reduced or restricted.

According to one aspect of the exemplary embodiment being described, Q3 is maintained at 87 $ft^3$/min to purge the developer subsystems 40, 42, 44, and 46, after the airflow to the cleaner subsystem 124 and the hybrid air knife subsystem 126 is restricted. This is a much greater airflow than was previously available to remove toner particles and other particulate matter from the developer subsystems 40, 42, 44, and 46, and the ductwork associated therewith. The greater airflow rate increases the amount of toner particles and other particulate matter removed from the developer subsystems

40, 42, 44, and 46, and the associated ductwork, thereby resulting in more effective toner particle and particulate matter removal. In addition, due to the use of the fluid regulating elements 130 and 132 to regulate the airflow through the attached subsystems, Q1 and Q2 remain at zero and hence $Q_T$ is only 87 $ft^3$/min. This total subsystem airflow is less than the overall airflow requirement of previous systems, while concurrently reducing the overall fluid displacement device 128 power consumption and noise emissions.

Thus the overall system airflow requirements are dramatically reduced from 135 $ft^3$/min to 87 $ft^3$/min during a purge mode, and maintained at the same 87 $ft^3$/min during normal operation, while still providing for improved cleaning performance via periodic purging stages of 87 $ft^3$/min at Q3 rather than the previous lower rates of e.g., 60 $ft^3$/min. The overall energy requirements of the fluid displacement device 128 are substantially reduced, as is the noise generated thereby, and the airflow through the ductwork network 142.

Figure 6:
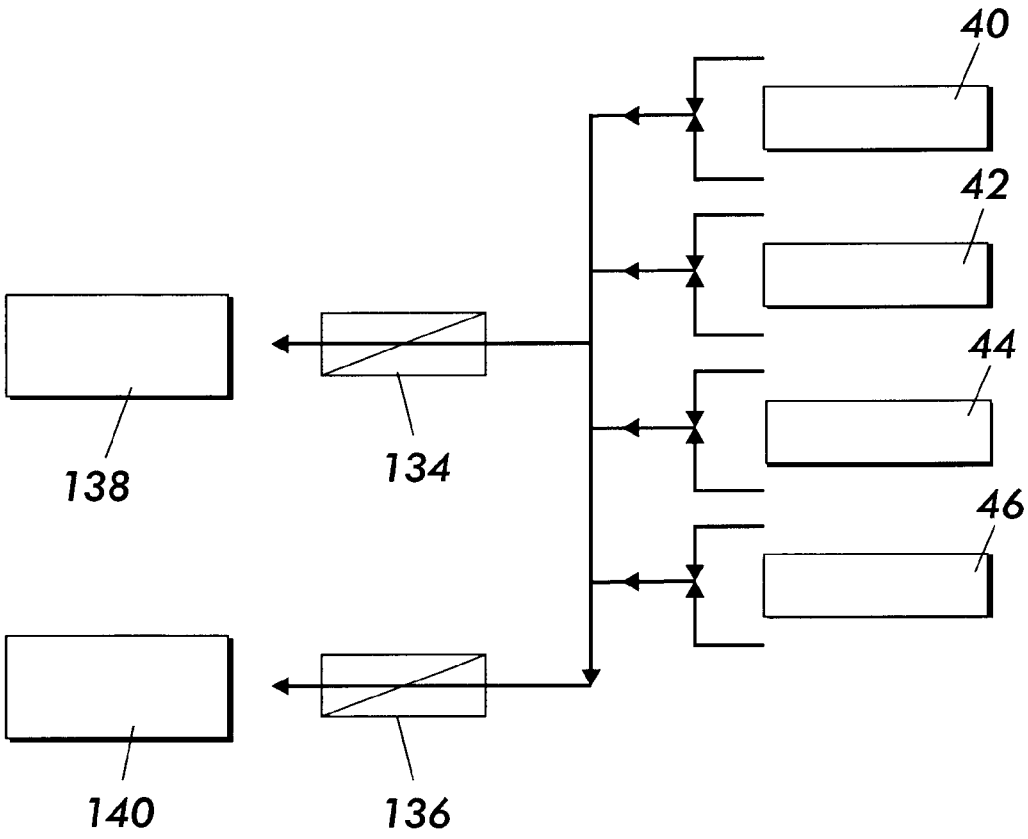
FIG. 6 is a schematic illustration of developer subsystems according to the teaching of the present invention.

In yet another alternative embodiment, an additional port is added to the air plenum 100 for purging as illustrated in FIG. 6. In this example embodiment, fluid regulating devices 134 and 136, such as for example shut-off valves, are coupled to the air plenum 100. During a visit from a service technician, a service vacuum 138 is attached to fluid regulating device 134 which otherwise normally closed, is opened by the vacuuming action, thus removing any toner particle or other particulate buildup in the air plenum 100 of the developer subsystems 40, 42, 44, and 46. Otherwise, a machine vacuum 140 is in fluid communication with the fluid regulating device 136 and functions generally as previously described. In yet another alternative embodiment, machine vacuum 140 can add additional negative air pressure in addition to that generated by the fluid displacement device 128 under normal conditions. When a purge is desired, the machine vacuum 140 is activated, thus increasing the airflow within the plenum 100 and removing any build up of toner particles and particulate matter.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. An image forming system, comprising:

a ductwork network for passing a fluid and particulate matter therethrough;

at least one fluid regulating element coupled to said ductwork network and to a subsystem of said image forming system that is distinct from a developer subsystem, for regulating a flow of said fluid through said ductwork network; and a fluid displacement device in fluid communication with said ductwork network for displacing fluid in said ductwork network.

2. The system of claim 1, wherein said fluid comprises air.

3. The system of claim 1, wherein said at least one fluid regulating element comprises a shut-off valve.

4. The system of claim 1, wherein said fluid displacement device comprises a blower.

5. The system of claim 4, wherein said blower creates a negative pressure to displace said fluid within said ductwork network and transport said particulate matter through said system.

6. The system of claim 1, further comprising at least one fluid regulating element coupled to said ductwork network and to said developer subsystem of said image forming system.

7. The system of claim 1, wherein said image forming system comprises an electrostatographic printing system.

8. The system of claim 1, wherein said subsystem comprises at least one of a cleaner subsystem and a hybrid air knife subsystem.

9. An image forming system, comprising:

a fluid displacement device connected to a ductwork network for maintaining a desired fluid pressure within said ductwork network; and a controller for controlling at least one fluid regulating element coupled to said ductwork network and at least one subsystem distinct from a developer subsystem, said at least one fluid regulating element regulating fluid flow through said ductwork network and said at least one subsystem of said image forming system.

10. The system of claim 9, wherein one of said at least one fluid regulating elements comprises a valve.

11. The system of claim 9, wherein said image forming system comprises an electrostatographic printing system.

12. The system of claim 9, wherein said subsystem comprises at least one of a cleaner subsystem and an air knife subsystem.

13. A method of cleaning a ductwork network in an image forming system, comprising the steps of:

activating a fluid displacement device to establish a selected fluid pressure and create a fluid flow within at least one section of said ductwork network for transporting particulate matter through said ductwork network;

regulating fluid flow to at least a predetermined portion of said ductwork network and to a subsystem coupled thereto distinct from a developer subsystem; and purging said at least one section of said ductwork network by activating at least one fluid regulating element, which in turn magnifies fluid pressure and increases fluid flow within said ductwork network.

14. The method of claim 13, wherein said purging includes diverting fluid flow and generating an increased fluid flow level through said at least one section of said ductwork network being purged to transport an additional amount of particulate matter through said ductwork network.

15. The method of claim 13, wherein said purging comprises the step of purging said ductwork network during one of cycle-up, cycle-down, and dead-cycle system states.

16. The method of claim 13, wherein said step of activating comprises the step of activating a blower to create a negative pressure within said ductwork network.

17. The method of claim 13, further comprising the step of storing said particulate matter in a depository of said system for subsequent removal.

18. The method of claim 13, further comprising the step of exhausting said particulate matter from said ductwork network and said image forming system.

* * * * *